United States Patent [19]

Satoh et al.

[11] 4,358,770

[45] Nov. 9, 1982

[54] MULTIPLE FREQUENCY ANTENNA FEED SYSTEM

[75] Inventors: Toshio Satoh, Sagamihara; Motoo Mizusawa, Yokohama; Fumio Takeda, Kamakura, all of Japan

[73] Assignee: Mitsubishi Denki Kabushiki Kaisha, Tokyo, Japan

[21] Appl. No.: 186,308

[22] Filed: Sep. 11, 1980

[30] Foreign Application Priority Data

Sep. 18, 1979 [JP] Japan ..... 54/119769

[51] Int. Cl.[3] ..... H01Q 13/00

[52] U.S. Cl. ..... 343/786; 343/772

[58] Field of Search ..... 343/786, 729, 755, 776, 343/781, 854, 772

[56] References Cited

U.S. PATENT DOCUMENTS

| | | | |
|---|---|---|---|
| 4,168,504 | 9/1979 | Davis | 343/786 |
| 4,199,764 | 4/1980 | Williams et al. | 343/786 |
| 4,258,366 | 3/1981 | Frosch et al. | 343/786 |

*Primary Examiner*—David K. Moore

*Attorney, Agent, or Firm*—Wenderoth, Lind & Ponack

[57] ABSTRACT

An multi-frequency antenna feed system has a corrugated conical horn and a diplexer interconnected serially to be operative in two frequency bands represented by frequencies $f_H$ and $f_L$ corresponding to wavelengths $\lambda_H$ and $\lambda_L$ respectively, where $2f_L \leqq f_H$. Corrugated grooves on the inner surface of the conical horn have the depth h, where $\lambda_L/4 < h < \lambda_L/2$. The corrugated conical horn has the inside diameter at its reduced diameter end which is not less than $2.6\lambda_o$, where $\lambda_o$ designates a wavelength at which the depth of the corrugated grooves ranges from three quarters of the wavelength and one complete wavelength.

2 Claims, 4 Drawing Figures

MULTIPLE FREQUENCY ANTENNA FEED SYSTEM

BACKGROUND OF THE INVENTION

This invention relates to improvements in an antenna feed system using a corrugated conical horn and operative in a multi-frequency band.

Conventional antenna feed systems of the type referred to have comprised a diplexer connected to a conventional corrugated conical horn for common use with a multiplicity of frequency bands. In such antenna feeding systems, higher modes which are propagable in the respective frequency bands, have been apt to be put in the so-called mode-spike due to the mode resonance between the corrugated conical horn and cutoff points existing in the diplexer. The mode spike has resulted in one of the causes for which the propagation characteristics of the system are distorted. In those antenna feed systems which are operative, for example, in a pair of higher and lower frequency bands, higher order mode spikes in the lower frequency band have been prevented from occurring by selecting the inside diameter of the waveguide section connecting the corrugated conical horn so as to be as small as possible so as to minimize the number of the propagable higher order modes and selecting the depth of corrugated grooves disposed circumferentially on the inner surface of the corrugated conical horn to be less than one half a wave length and greater than or nearly equal to one quarter the wave length in the higher frequency band and also to be small than a wavelength in the lower frequency band so that the inner corrugated surface of the corrugated horn is regarded as the inner smooth surface of conventional horns.

Also, a small number of higher order modes which are propagable in the higher frequency band, have been able to be prevented from being put in the mode spike by properly selecting the dimension and shape of the corrugated grooves.

Those measures have further provided a rotationally symmetrical radiation pattern for the higher frequency band but not resulted in a rotationally symmetrical radiation pattern for the lower frequency band because the depth of the corrugated grooves is too shallow with respect to electromagnetic waves lying in the lower frequency band and therefore, the advantages of the corrugated conical horn have been unable to be effectively utilized.

Accordingly, it is an object of the present invention to provide a new and improved antenna feed system for common use with a multiplicity of frequency bands and exhibiting a rotationally symmetrical radiation pattern over all the frequency bands by means the means of preventing the occurrence of high order mode spikes between a corrugated conical horn involved and cutoff points in a diplexer connected thereto.

SUMMARY OF THE INVENTION

The present invention provides an antenna feeding system which is operative in a multi-frequency band and comprising a corrugated conical horn including a multiplicity of corrugated grooves disposed circumferentially at predetermined equal intervals on the inner surface thereof, and a diplexer for common use with a multiplicity of frequency bands and connected to the corrugated conical horn through a connecting waveguide section, the corrugated grooves having a depth selected to be from one quarter to one half a wavelength of the lowest one of the multiplicity of frequency bands and simultaneously from an add multiple of one quarter of the wavelength of each of the remaining frequency bands to the sum of said odd multiple of one quarter of the wavelength and one quarter the wavelength in each of the remaining bands, and the waveguide section having an inside diameter selected not to be less than 2.6 times a wavelength corresponding to a frequency at which the depth of the corrugated grooves has a length of between three quarters and one wavelength.

Preferably, the antenna feeding system comprises the diplexer for common use with the multiplicity of frequency bands, a circular waveguide, and the corrugated conical horn connected in a series circuit relationship to one another.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENT

Figure 1:
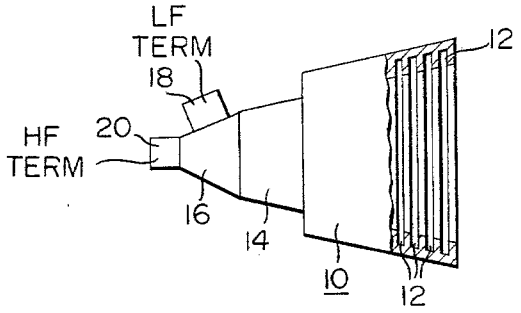
FIG. 1 is a plan view of an antenna feed system with a corrugated conical horn useful in explaining the characteristic features of corrugated conical horns with the horn partly illustrated in longitudinal section.

Before the prior art concerning the present invention is described, the characteristic features of corrugated conical horns will now be described in conjunction with FIG. 1. The arrangement illustrated in FIG. 1 comprises a corrugated conical horn 10 including a multiplicity of corrugated grooves 12 circumferentially disposed at predetermined equal intervals on the inner surface thereof, and a circular waveguide 14 connected to the reduced diameter end of the horn 10 to energize the latter. The circular waveguide 14 is shown in FIG. 1 as being in the form of a frustum of a cone similar to that of the conical horn 10 and includes a reduced diameter end connected to a diplexer 16 also shown in FIG. 1 as being in the form of a frustum of a cone. The diplexer 16 includes a terminal shown at block 18 connected to the conical surface thereof and another terminal shown at block 20 connected to the reduced diameter end thereof.

When the corrugated grooves have an admittance exhibiting a capacitive susceptance as viewed from the entrance thereof to the bottom thereof, the corrugated conical horn 10 has a radiation pattern including low side lobes and a rotationally symmetrical beam. Furthermore the resulting cross-polarized components are low. As is well known, this capacitive susceptance is developed with the corrugated grooves 12 having the depth ranging from $(2n-1)\lambda/4$ to $2(n-1)\lambda/4$ where, $\lambda$ designates the wavelength of an electromagnetic wave involved and n is any integer. Therefore, the corrugated conical horn having the depth such as specified above of the corrugated grooves is effective for the primary radiator of an antenna which is highly efficient and has low side lobe characteristics.

The characteristic features of the corrugated conical horn as described above result from the fact that the corrugated grooves 12 convert the $TE_{11}$ mode which is the fundamental wave propagating through the circular waveguide 14 to the so-called hybrid mode in the corrugated conical horn, or the $EH_{11}$ mode in the latter.

When the circular waveguide 14 is connected to the corrugated conical horn 10, problems are encountered particularly in the following respect: Since the multiplicity of the corrugated grooves 12 are disposed at predetermined equal intervals on the inner surface of the corrugated conical horn 10, the latter has the properties exhibited by circuits having one type of the periodic structure so that the horn presents a band pass characteristic to almost all modes propagated through the circular waveguide.

For example, it is assumed that the circular waveguide 14 propagates, in addition to the $TE_{11}$ mode, a higher order mode or modes therethrough. It is also assumed that the corrugated conical horn 10 has been designed and constructed so that, with the horn operated in a pass band for the $EH_{11}$ mode, the $TE_{11}$ mode is converted to the $EH_{11}$ mode which, in turn, propagates through the corrugated conical horn 10. Under the assumed conditions, a higher order mode or modes propagating through the circular waveguide 14 can not be always passed through the corrugated conical horn 10. When the higher order mode or modes is or are cut off at the corrugated conical horn 10, the same is reflected toward the circular waveguide 14 from the corrugated conical horn 10. Under these circumstances, the reflected higher order mode or modes is or are further completely reflected again toward the corrugated conical horn 10 from a cutoff point or points existing in the diplexer 16 or the like which energizes the circular waveguide 14.

Accordingly, a mode spike or spikes is or are formed between the cutoff point or points in the diplexer 16 and the corrugated conical horn 10 resulting in the occurrence of the so-called mode resonance of the higher order mode or modes. This resonance forms one of the causes for which the associated propagation characteristics of the system are distorted.

As apparent from the occurring mechanism thereof, the abovementioned mode resonance is apt to occur with the corrugated conical horn 10 operated in a wide frequency band or over a multi-frequency band.

In order to avoid this objection, conventional antenna feed systems for common use with a multiplicity of frequency bands have been constructed as follows: It is assumed that such systems are operated in a pair of lower and higher frequency bands having frequencies of $f_L$ and $f_H$ and corresponding wavelengths of $\lambda_L$ and $\lambda_H$ respectively and that the relationship $2f_L \leqq f_H$ holds.

Figure 2:
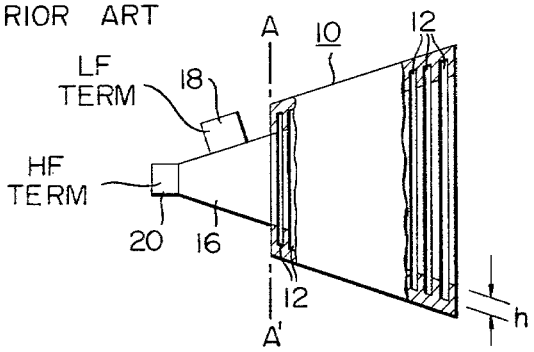
FIG. 2 PRIOR ART
FIG. 2 is a plan view of a conventional antenna feed system including a corrugated conical horn and operative in a multi-frequency band with the corrugated conical horn illustrated partly in longitudinal section.

In FIG. 2, wherein like reference numerals designate the components identical to those shown in FIG. 1, there is illustrated a conventional antenna feeding system operative in the pair of frequency bands as described above. The arrangement illustrated is different from that shown in FIG. 1 only in that, in FIG. 2, the diplexer 16 is directly connected to the corrugated conical horn 10 with the circular waveguide 14 being omitted. The diplexer 16 is shown in FIG. 2 as being in the form of a frustum of a cone similar to that of the corrugated conical horn 10 and has the terminals 18 and 20 respectively used with the lower and higher frequency bands having the frequencies $f_L$ and $f_H$.

In FIG. 2, broken line A—A′ designates a connecting plane in which the diplexer 16 is directly connected to the corrugated conical horn 10. As shown in FIG. 2, the diplexer 16 includes an open end having the inside diameter equal to that of the reduced diameter end of the horn 10 minus twice the depth h of the corrugated grooves 12.

The diplexer 16 is designed and constructed so as to successively separate electromagnetic waves ranging from the lower to the higher frequency band at the end of the corrugated conical horn 10. As a result, that end of the diplexer filter 16 connected to the corrugated conical horn 10 has its inside diameter making an oversized waveguide with respect to both electromanetic waves of higher frequencies in the lower frequency ($f_L$) band and electromagnetic waves in the higher frequency ($f_H$) band. Therefore, the confined resonance may be possible to occur between the diplexer 16 and the corrugated conical horn 10.

In order to avoid the occurrence of this resonance, the conventional antenna feed systems as described above has contemplated the minimization of the number of higher order modes capable of propagating through the corrugated conical horn 10. To this end, the connecting plane A—A′ between the corrugated conical horn 10 and the channel separation filter 16 has had first its inside diameter selected to be as small as possible and then the corrugated grooves 12 has had the depth h determined by the inequality $$\lambda_H/2 > h \geqq \lambda_H/4 \qquad (1)$$

and h is also selected to be small with respect to $\lambda_L$.

When doing so, the depth h of the corrugated grooves 12 is shallow with respect to waves in the lower frequency ($f_L$) band so that an admittance in that frequency band exhibited by the corrugated grooves 12 presents a high inductive susceptance characteristic. This means that the corrugated conical horn 10 is similar in operation to usual conical horns so as to be prevented from exhibiting the cutoff characteristic to higher order modes generated at higher frequencies in the lower frequency ($f_L$) band. This results in the prevention of the occurrence of the mode resonance.

Regarding a small number of higher order modes generated in the higher frequency ($f_H$) band, the dimension and shape of the corrugated grooves 12 are properly selected to prevent the occurrence of the mode resonance The conventional antenna feed system having the parameters as described above is advantageous in that the mode resonance can be prevented from occurring as will be understood from the foregoing and also a rotationally symmetrical radiation pattern can be provided for the electromagnetic waves in the higher frequency ($f_H$) band but it is disadvantageous in that there can not be provided such a radiation pattern by making the most of the advantages of the corrugated conical horn because the corrugated grooves exhibit the inductive susceptance as described above.

The present invention contemplates the elimination of the disadvantages of the prior art practice as described above by equalizing the depth of the corrugated grooves to from one quarter to one half a wavelength in the lowest one of a multiplicity of frequency bands involved and also to form an odd multiple of one quarter wavelength to the sum of that odd multiple of one quarter wavelength and one quarter wavelength in each of the remaining frequency bands. Furthermore, in order to prevent the mode resonance from occurring, the inside diameter of the connecting plane A—A' in which the corrugated conical horn 10 is connected to the wave separation filter 16, is selected to be equal to or more than 2.6 times a wavelength of a frequency at which the depth of the corrugated grooves ranges from three quarters wavelength and one complete wavelength.

Figure 3:
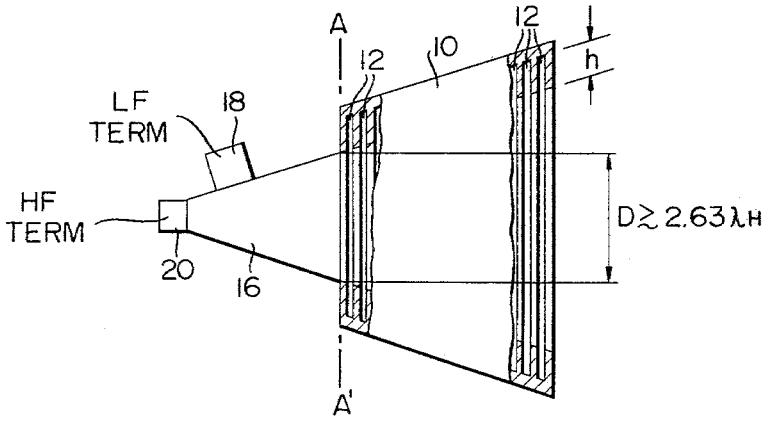
FIG. 3 is a plan view of one embodiment according to the multi-frequency band antenna feed system of the present invention with parts illustrated in longitudinal section.

Referring now to FIG. 3 wherein like reference numerals designate the components identical or corresponding to those shown in FIG. 2, there is illustrated one embodiment according to the multifrequency band antenna feed system of the present invention. The arrangement illustrated is similar to that shown in FIG. 2 except for the parameters of the corrugated conical horn. It is assumed here that the arrangement is operative in a pair of frequency bands identical to those described above in conjunction with FIG. 2.

It will readily be understood that the arrangement of FIG. 3 is characterized in that the depth of the corrugated grooves 12 is selected such that $$\lambda_L/4<h<\lambda_L/2 \quad (2)$$

and that the inside diameter of the connecting plane A—A' between the corrugated conical horn 10 and the diplexer 16 is selected to greater than or equal to $2.63\lambda_H$.

From the foregoing it is seen that, in the arrangement of FIG. 3, the depth of the corrugated grooves 12 is selected to present a capacitive susceptance in each of the frequency bands including the frequencies $f_L$ and $f_H$ respectively. Therefore the arrangement is advantageous in that a radiation pattern in each of those frequency bands has good characteristics due to the best use of the characteristics of the corrugated conical horn 10.

The arrangement of FIG. 3 will now be described in terms of the mode resonance of the higher order modes. In the frequency ($f_L$) band, higher order modes are generated at higher frequencies but the number thereof is small because those frequencies are relatively low. Under these circumstances, the occurrence of the mode resonance can be prevented by properly selecting the dimension and shape of the corrugated grooves 12 as in the arrangement of FIG. 2.

On the other hand, the number of higher order modes generated in the higher frequency ($f_H$) band is large. In the arrangement of FIG. 3, however, the corrugated conical horn 10 has the inside diameter D on the reduced diameter end thereof approximately equal to at least $2.63\lambda_H$ as described above. That is, the inside diameter D is selected to be large with respect to wavelengths of electromagnetic waves included in the high frequency ($f_H$) band with the result that it is possible to design the corrugated conical horn 10 to present a low cutoff attenation to higher order modes propagating through the same which will subsequently be described.

When the connecting plane between the corrugated conical horn 10 and the diplexer 16 is small in inside diameter, a small number of the higher order modes are permitted to propagate through that connecting plane. As a result, higher order modes excited in the diplexer 16 are cutoff by the corrugated conical horn 10 unless the higher order modes appearing in conventional waveguide sections are converted to those higher order modes appearing in corrugated waveguide sections.

On the contrary, when the connecting plane or reduced diameter end of the corrugated conical of horn 10 is large in inside diameter, a large number of higher order modes can propagate toward both the diplexer 16 and the corrugated conical horn 10. Therefore, any one of the higher order modes generated within the diplexer 16 and excited in the diplexer 16 can be converted to modes similar in field distribution to any of a multiplicity of modes capable of propagating through the corrugated conical horn 10. This results in a decrease in cutoff attenuation exhibited by the corrugated conical horn 10.

This decrease in cutoff attenuation causes a reduction in Q relative to the higher order modes resonances formed of the diplexer 16 and the corrugated conical horn 10. This reduction in Q permits the influence of the mode resonance on the propagation characteristics to be small.

Since the corrugated conical horn (10) has a configuration varying along the axis of propagation, it is difficult to theoretically determine the cutoff attenuation of each of the higher order modes exhibited by the corrugated conical horn 10. Accordingly, the inside diameter at the reduced diameter end of the corrugated conical horn 10 has been experimentally determined at and below which the cutoff attenuation becomes small enough to prevent the occurrence of the mode resonance.

In order to determine whether or not the mode resonance occurs, one can observe the frequency characteristics of an electric power reflected from the connection of the corrugated conical horn 10 to the diplexer 16 and seeing if a spike-shaped variation is developed in the reflected power due to a large change in phase of the reflected wave occurring at the resonance frequency.

Figure 4:
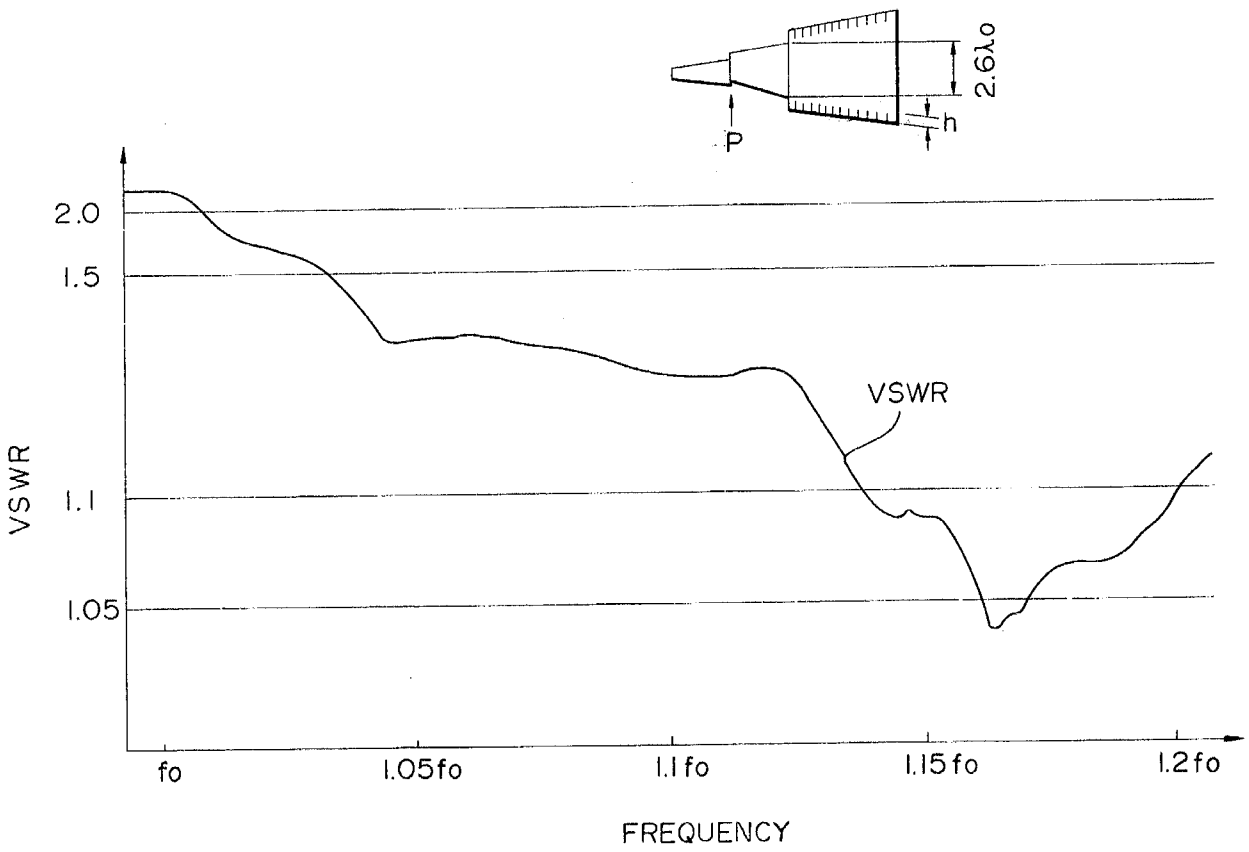
FIG. 4 is a graph illustrating the frequency characteristic of the arrangement shown in plan view on the upper portion thereof.

FIG. 4 illustrates the frequency characteristic of a VSWR (which is an abbreviation for a voltage standing-wave ratio) obtained by an experiment conducted with the diplexer 16 having the inside diameter of $2.6\lambda_o$ at the larger diameter end thereof and connected to the corrugated conical horn 10 including the corrugated grooves 12 having the depth h of $3\lambda_o/4$ where $\lambda_o$ designates a wavelength at a frequency $f_o$. In the experiment, the diplexer 16 has been provided at an intermediate point P having the inside diameter of $1.8\lambda_o$ with a discontimity as shown on the upper portion of FIG. 4 to generate intentionally higher order modes.

In FIG. 4, the VSWR is plotted on the ordinate against the frequency on the abscissa, and the ordinates 2.0, 1.5, 1.1 and 1.05 correspond respectively to the numerals −10, −14, −26 and −32 db in terms of a return loss. From FIG. 4, it is seen that the frequency characteristic of the VSWR does not include any spike-shaped variations. This indicates that the inside diameter of $2.6\lambda_o$ at the connection of the corrugated conical horn to the diplexer decreases the cutoff attenuation exhibited by the corrugated conical horn.

While the present invention has been illustrated and described in conjunction with a pair of frequency bands respresented by frequencies $f_L$ and $f_H$, it is to be understood that the same is equally applicable to a multiplicity of frequency bands in which the corrugated grooves having a constant depth exhibits a capacitive susceptance as an admittance.

The present invention is advantageous in that, by selecting the inside diameter at a reduced diameter end of a corrugated conical horn to be large, the mode resonance can be prevented from occurring, and by selecting the depth of corrugated grooves so as to exhibit a capacitive susceptance in each of the multiplicity of frequency bands, a rotationally symmetrical radiation pattern can be provided in each of the frequency bands.

While the present invention has been illustrated and described in conjunction with a single preferred embodiment thereof it is to be understood that numerous changes and modifications may be resorted to without departing from the spirit and scope of the present invention.

What we claim is:

1. An antenna feed system operative in a multi-frequency band, comprising a corrugated conical horn including a multiplicity of corrugated grooves disposed circumferentially at predetermined equal intervals on the inner surface thereof, and a diplexer for common use with a multiplicity of frequency bands, said diplexer being connected to said corrugated conical horn through a connecting plane, said corrugated grooves having a depth selected to be between one quarter and one half of the wavelength of the lowest one of said multiplicity of frequency bands, and said depth also being selected to be from an odd multiple of one quarter of the wavelength of each of the remaining frequency bands to the sum of said odd multiple of one quarter of the wavelength of each of said remaining frequency bands and one quarter of the wavelength of each of said remaining frequency bands; wherein said connecting plane has an inside diameter selected not to be less than 2.6 times a wavelength corresponding to a selected frequency where said depth of said corrugated grooves is between three quarters and one wavelength at said selected frequency.

2. An antenna feed system as claimed in claim 1, wherein said diplexer for common use with said multiplicity of frequency bands, a circular waveguide and said corrugated conical horn are connected in a series circuit relationship with respect to one another.

* * * * *